United States Patent [19]

Woodward

[11] 4,358,281

[45] Nov. 9, 1982

[54] WINCH-MOUNTED SAILBOAT OARLOCK

[76] Inventor: William R. Woodward, 520 E. 76th St., New York, N.Y. 10021

[21] Appl. No.: 161,269

[22] Filed: Jun. 20, 1980

[51] Int. Cl.[3] ..... B63B 17/00; B63H 16/06

[52] U.S. Cl. ..... 440/109; 440/104; 114/364; 114/39; 114/218; 403/376

[58] Field of Search ..... 440/104–110; 114/39, 218, 270, 111, 364; 403/361, 376–379; 9/1.7, 1.1

[56] References Cited

U.S. PATENT DOCUMENTS 1,001,475 8/1911 Starin ..... 440/109

3,968,953 7/1976 Guangorena ..... 254/342

FOREIGN PATENT DOCUMENTS 587098 4/1947 United Kingdom ..... 114/218

*Primary Examiner*—Trygve M. Blix

*Assistant Examiner*—D. W. Keen

*Attorney, Agent, or Firm*—Frishauf, Holtz, Goodman & Woodward

[57] ABSTRACT

An oarlock horn member is supported, at an appropriate tilt, above a base plate from a winch such as is commonly used on each side of the cockpit of a sailboat. The underside of the base plate has a locking type plug of the kind used to engage and lock in a winch handle for cranking the winch. When the winch is not in use for trimming sails, it can be converted into an oarlock pivot by locking in the present oarlock, to provide auxiliary propulsion for small cruising sailboats for use in calm weather or for maneuvering in harbors, either when the sailboat is not equipped with an engine, or when the engine is out of fuel, or otherwise out of service, or in sailboat races that permit rowing in order to enliven calm weather contests.

5 Claims, 3 Drawing Figures

WINCH-MOUNTED SAILBOAT OARLOCK

This invention concerns an oarlock for a small sailboat for enabling a sailboat not originally equipped with oarlocks to be made ready for propulsion by rowing in a simple manner.

Sailboats big enough to carry living quarters but not elaborate or big enough to carry inboard engines are commonly equipped with an outboard motor for auxiliary power to enable the craft to be propelled in the absence of wind and to be manuevered in an anchorage or marina with more flexibility than usually could be accomplished under sail.

Outboard engines are usually mounted in an exposed position, subject to failure and being put out of commission by unusual wave action or various malfunctions. Furthermore, in calm conditions it may be desired not to use the engine to save fuel for manuevering at close quarters in harbors and marinas.

It is recognized that sailboats up to perhaps to 10,000 lb. displacement can be propelled by rowing, particularly if an individual rower is available for each oar.

One recent design of a cruising sailboat particularly providing for rowing the craft shows an increasing interest in providing manual propulsion for recreational boats.

The rapidly increasing cost of motor fuel also contributes to the renewed interest in manual propulsion.

Most small sailboats large enough to have cabin space sufficient for overnight accomodation are not equipped with oarlocks and conventional oarlocks are not easily fitted to them. Attempting to row them without oarlocks results in scraping and damaging finished surfaces, which is particularly objectionable in a pleasure boat and is of limited efficiency for propulsion.

SUMMARY OF THE INVENTION

It is an object of this invention to provide an oarlock device that can be fitted onto many boats not originally designed for auxilary propulsion by rowing, without requiring the installation of hardware by boring holes into the hull, deck or other parts of the boat structure.

Briefly, advantage is taken of the presence on a large proportion of the sailboats big enough to have overnight accomodation, and small enough to be movable by rowing, of winches located clear of other equipment and in position at either side of cockpit or deck space so that an oarlock can be mounted on the winch for good effect. The winch in question should be a winch having a removable handle and capable of accepting a conventional locking handle for working of the winch. When the oarlock is to be used, the winch is not in its normal service. The oarlock comprises a plate suitable for seating on the top surface of the winch and a downward projection in the shape of the hub or stud of a winch handle with releasable locking means to secure the plate in position against the top of the winch. Above the plate are located not only the release lever for the locking means, but also the oar support and oarlock horns.

Winches are sometimes mounted with outwardly slanted top surfaces, in which case the oarlock may be supported with horns aligned in a plane passing through the winch axis. In most case, however, the top surface of the winch is approximately horizontal and because of the relatively high elevation of the top of the winch above the surface of the water, it is desirable that the oarlock horns be in a plane tilted with respect to the winch axis.

When the oarlock is used, the winch turns back and forth and its ratchet operates in an idling fashion, but the amount of use of the oarlock for occasional auxiliary propulsion of the boat is unlikely to result in appreciable wear of the winch parts.

The oar length is normally somewhat greater than is usually provided on an ordinary rowboat and will usually range from 8 to 12 feet, depending upon the size of the boat and, particularly, the height of the oarlock above the water. The invention is usable only if there is clear unobstructed space outboard of the winch above the edge of the deck and between lifeline stanchions and other equipment located further outboard than the winch.

BRIEF DESCRIPTION OF THE DRAWINGS

The invention is further described by way of illustrative example, with reference to the annexed drawing in which.

DESCRIPTION OF AN ILLUSTRATIVE EMBODIMENT

Figure 1:
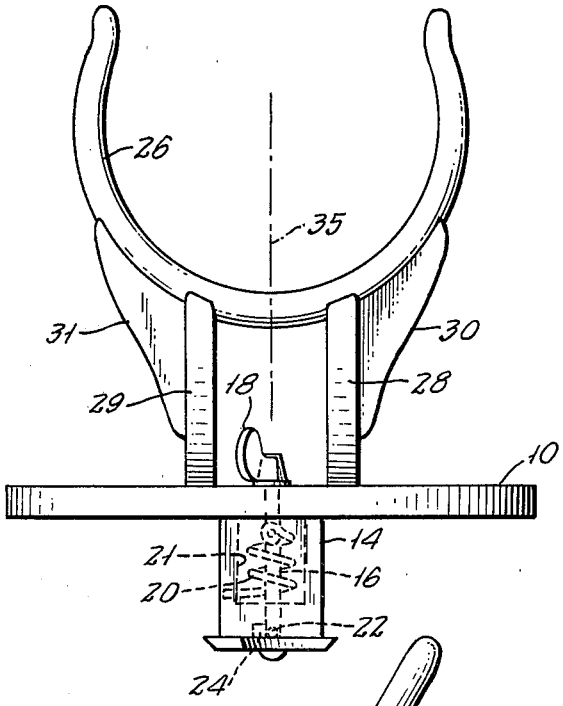
FIG. 1 is a face view of an oarlock according to the invention.

As shown in the drawings, which provide different views of the same example of an oarlock according to the invention, the oarlock has a platform constituted by the disk-shaped plate 10 that is designed to rest on the top of a winch and to be held close to the winch top by means of the locking detent or pawl 12 at the bottom of the square plug 14 extending downward at the center of the plate 10. The plug 14 is of the size of a standard winch handle wrench plug, which is to say its cross-section is square, about 17 millimeters on a side and its length is about 20 millimeters. The locking pawl 12 is likewise 17×17 millimeters and preferably has beveled sides. The plug 14 may be of metal or plastic, but the pawl 12 is preferably of a hard metal, such as steel, preferably a rust-free type, and is affixed at its center to a shaft 16 that passes through the plug and capped by a release lever 18. A spring 20 holds the pawl 12 in the locked position, illustrated in the drawing, with its corners between two of the indentations in the hole in the top of the winch through the square plug 14 may fit in either of two positions. The plug 14 may be screwed, welded, or otherwise affixed to the plate 10.

To insert the oarlock, the procedure is the same as for the insertion of a locking type of winch handle, namely the lever 18 is moved against the spring pressure until the pawl 12 has it periphery aligned with the plug 14. A stop 22 on the shaft 16, moving in a cavity 24 in the end of the plug 14, limits the movement of the pawl 12 between the position shown in the drawing and the position in which its perimeter is aligned with perimeter of the plug 14. The plug 14 has a bore for the shaft 16 (as has also the plate 10) and a second cavity 21 for the spring 20.

The oarlock horn crescent 26 is mounted on two vertical plates 28 and 29 of generally triangular shape so that it straddles the location of the release lever 18 on the plate 10. Fillets 30 and 31 are soldered, brazed or welded to hold the oarlock horn crescent 26 at an angle to the axis 35 of the plug 14 and shaft 20, as shown particularly in FIG. 2.

The axis 35 is, of course, the axis of the winch on which the oarlock is mounted and it is commonly approximately vertical although in many cases it is tipped outboard.

It is not practical to provide an oarlock in which the angle 36 is variable, but the construction illustrated in the drawing makes it possible to use the same parts and to solder, braze or weld them in position to fix the angle, so that the model in which the angle 36 is zero can be made for tipped winches and a model like that shown in the drawings can be made for winches which have a vertical axis. The broken line 40 illustrates the downwardly position that an oar can take in the oarlock illustrated, assuming, of course, that the plate 10 extends far enough outward so that the line 40 will clear the edge of the winch, and assuming also that the location of the winch is sufficiently above the deck for the line 40 to clear the toe-rail or gunwall of the boat. The angle 42 between the line 40 and the axis 35 (the latter being assumed to be vertical) is about 54°, which is to say that the line 40 is at about 46° below the horizontal. This angle should generally be at least 40°. The 46° value is appropriate for an oar three meters long used in an oarlock one meter or slightly more above the water level, or a somewhat shorter oar used in an oarlock closer to the water level as would be the case in the smaller boats big enough to have overnight accomodations.

Figure 2:
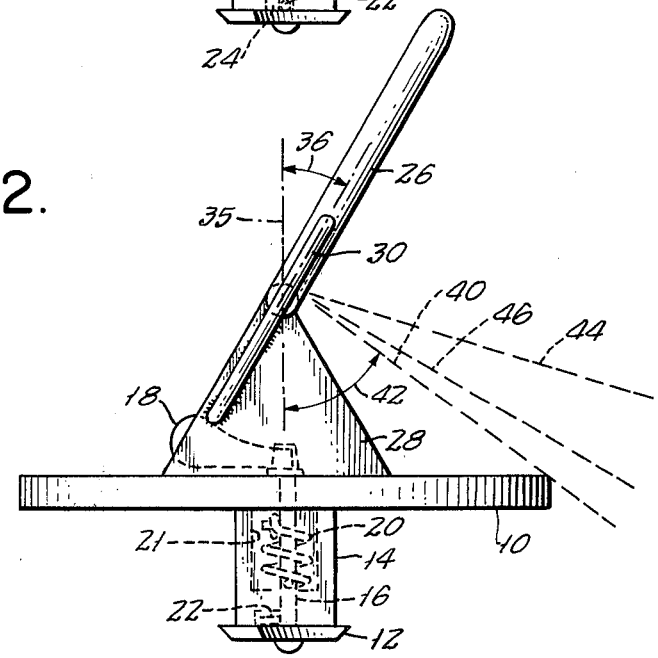
FIG. 2 is a side elevation of the same.
Figure 3:
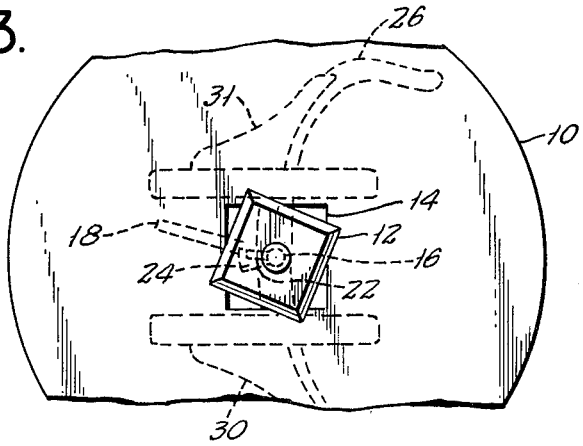
FIG. 3 is a partial bottom view of the oarlock of FIGS. 1 and 2.

The line 44 of FIG. 2 is typical of the position of the oar when its blade is out of the water and the line 46 typical of the position when the oar is propelling the boat. Lines 40, 44 and 46 represent, of course, the position of the bottom of the oar shaft rather than its center. It should be noted that the top of the plate 10 should be rounded or beveled at the line 40 in order to avoid damage to the oar when it is rowed a bit too deeply. In the illustrated case, the angle 36 is about 30°, which corresponds to a kind of average rowing position of the oar.

The plate 10 cannot rise away from the top of the winch sufficiently to tip appreciably because of the locking pawl 12 and the idling winch provides an excellent swivel for the oarlock. The oarlock is readily removable and easily storable and makes possible the provision of simple rowing propulsion. In most cases, the oars would be used by an oarsman or two standing in the cockpit and rowing after the fashion of a gondolier, but it has also been found practical to row from a sitting position either in front or behind the oar in the usual cockpit seat without particular discomfort, although it is possible to exert more force from a standing position.

This invention is applicable in various shapes of oarlock horns and various kinds of arrangements for mounting the oar cradle itself on the plate 10, which, in cooperation with the locking plug, stabilizes the axis of the oarlock.

The oarlock horn member 26 may be referred to more technically as an oar-fulcrum cradle.

It is sometimes convenient to describe the slant of the oar-fulcrum cradle in terms of the inclination of its median plane to the median plane of the base plate, rather than inclination with respect to the winch axis. Thus, when the angle between the reference plane of the cradle and that of the base plate is greater than 45° (which angle appears to be a practical minimum) the cradle plane is at an angle 36 of less than 45° to the winch axis 35.

I claim:

1. An oarlock for a sailboat equipped with port and starboard winches of the kind having a socket in the top surface thereof for receiving the locking plug of a locking-type detachable winch-driving crank, said oarlock comprising:

a base member the bottom surface of which is shaped so as to rest on the top surface of a winch in an attitude in which said base member extends over said top surface for bracing thereagainst to maintain parallelism therewith;

a plug centrally fixed on said base member extending therebelow and equipped with a locking tip portion for locking said base member to the turning portion of said winch while holding said base against movement away from the top portion of the winch;

means for holding said locking tip portion of said plug in locking position and for enabling it to be displaced therefrom to a position suitable for inserting said plug into said winch and for removing it from the winch, and an oar-fulcrum cradle, and means for supporting said oar-fulcrum cradle on said base member firmly above said member.

2. An oarlock as defined in claim 1, in which said base member is in the form of a plate and in which means for holding said locking tip portion and for enabling it to be displaced include a lever mounted on said base plate and in which said supporting means support said oar-fulcrum cradle so as to straddle said lever without interfering with its movement.

3. An oarlock as defined in claim 1 or claim 2, in which said oar-fulcrum cradle is in the form of a conventional oarlock horn member.

4. An oarlock as defined in claim 1 or claim 2, in which said oar-fulcrum cradle has its median plane at an oblique angle to the median plane of said base member, said angle being not less than 45.

5. An oarlock as defined in claim 1 or claim 2, in which said oar-fulcrum cradle is supported by said at a height above said base member permitting an oar cradled therein to be dipped at an angle of at least 40 below the median plane of said base member without touching said base member.

* * * * *

UNITED STATES PATENT AND TRADEMARK OFFICE

CERTIFICATE OF CORRECTION

PATENT NO. : 4,358,281

DATED : November 9, 1982

INVENTOR(S) : William R. Woodward & Mary Lou Patton

It is certified that error appears in the above—identified patent and that said Letters Patent is hereby corrected as shown below:

On the title page, "[76] Inventor:" should read -- [76] Inventors --.

William R. Woodward
3255 Randall Avenue
Bronx, New York 10465 and

Mary Lou Patton
307 E. 78th Street
New York, New York 10021

Signed and Sealed this

*Sixth* Day of *September 1983*

[SEAL]

*Attest:*

*Attesting Officer*

GERALD J. MOSSINGHOFF

*Commissioner of Patents and Trademarks*